United States Patent [19]

del Nero

[11] Patent Number: 4,466,264

[45] Date of Patent: Aug. 21, 1984

[54] HIGH SAFETY LOCK DEVICES

[75] Inventor: Claude del Nero, Le Chesnay, France

[73] Assignee: Fichet-Bauche, France

[21] Appl. No.: 345,421

[22] Filed: Feb. 3, 1982

Related U.S. Application Data

[63] Continuation-in-part of Ser. No. 113,182, Jan. 18, 1980, Pat. No. 4,316,371.

[51] Int. Cl.[3] ..... E05B 63/00

[52] U.S. Cl. ..... 70/417; 70/134; 70/380

[58] Field of Search ..... 70/124, 129, 134, 379 R, 70/379 A, 380, 381, 416, 417, 447, 451, 452, DIG. 60

[56] References Cited

U.S. PATENT DOCUMENTS 4,248,068 2/1981 Essen ..... 70/134

4,316,371 2/1982 del Nero ..... 70/417

*Primary Examiner*—Robert L. Wolfe

*Attorney, Agent, or Firm*—Kane, Dalsimer, Kane, Sullivan and Kurucz

[57] ABSTRACT

A safety lock is provided with two plate assemblies, the first to be mounted on the outside of the door leaf and the second on the inside thereof. Each one of these plate assemblies comprises a first plate adapted to be placed on the side of the door leaf and having a first opening for receiving an actuating mechanism, a second opening housing a transmission gear mechanism, and corner holes for passing fasteners which hold the two plate assemblies together. A second plate is on the outer face of the first plate which comprises holes providing bearings for each gear of the transmission mechanisms as well as holes wider than the ends of the fasteners for housing the same therein. A third plate is spot welded on the outer face of the second plate and prevents access to the transmission mechanism. In the outer plate assembly, this third plate covers the ends of the fasteners and has only one hole, shaped in correspondence with the respective key hole opening of the cylinder lock.

37 Claims, 10 Drawing Figures

HIGH SAFETY LOCK DEVICES

BACKGROUND OF THE INVENTION

This application is continuation in part of copending application No. 113,182 filed Jan. 18, 1980, and now U.S. Pat. No. 4,316,371.

The present invention relates to assemblies for locking and unlocking doors and which comprise a slidable bolt mounted in the door leaf and actuated under control of a barrel in a safety cylinder operated by a key. The rotation of the barrel which is only possible with a selected key actuates a tail piece which drives the sliding movement of the bolt.

Assemblies of this type are known wherein the cylinder is housed in a passage extending through the door leaf, one end of the cylinder being rigidly connected to the door leaf by means of two screws engaged in a plate which is secured to the door leaf.

While such an arrangement benefits from the safety provided by the cylinder, it does not prevent the unauthorized opening of the door by forcibly rotating end of the cylinder which protrudes in the outer face of the door leaf.

Also some existing assemblies are mounted in the door and secured thereto by fasteners such as bolts which may be forcibly removed or cut.

BRIEF SUMMARY OF THE INVENTION

An object of the invention is thus to provide a lock assembly which makes attempts at fraudulent entry impossible or more difficult and efficiently opposes drilling, boring, tearing off or the like of parts of the assembly in such attempts.

An other object is to provide this result by means which are simple to use and inexpensive.

Still another object of the invention is to increase the safety of a lock assembly by providing means such that the safety cylinder may be easily replaced.

A further object of the invention is to provide a door lock assembly for actuating a dead bolt housed in the edge of the door leaf and which protrudes very little on either side of the door leaf, while providing an excellent safety against anauthorized entry.

Still a further object of the invention is to provide such a door lock assembly which may be operated from either side of the door independently of the side from which the lock had been last operated. In this respect the invention encompasses embodiments wherein such a door lock assembly may be operated by a key from either side of the door.

One object of the invention is to provide such a door lock assembly which comprises two cylinder locks housed in parallel in the door, each of which may be operated from a respective side of the door.

A further object is to provide plate assemblies for a door lock assemblies as mentioned which may be respectively mounted on the inner and the outer side of the door, each assembly having an opening providing an access for operating the lock assembly by a key on at least one side, at least the outer plate assembly providing protection against attempts at unauthorized access.

A further object of the invention is to provide plate assemblies of the kind just mentioned wherein at least the outer plate assembly has means for housing and protecting a transmission mechanism whereby the dead bolt may be actuated, under control of a key or a knob on the opposite side of the door.

According to an embodiment, the invention contemplates providing an inner and an outer plate assembly each one adapted respectively for mounting on the inner face and outer face of a door leaf for protecting the access to the operating mechanism of a dead bolt mounted for sliding movement in and out of the edge of the door leaf. The movement of the bolt is controlled by the rotation of a flat control bar within an opening in the door leaf. Each end of the control bar is rotatably coupled with a transmission mechanism within a respective one of the plate assemblies. Each plate assembly is associated with respective tail piece actuating mechanism whereby the respective tail piece may be operated from a respective side of the door leaf. The actuating mechanism associated with the outer plate assembly is a cylinder lock having a key hole opening. Each plate assembly may comprise a first plate having a first opening formed therethrough for providing controlling access from the outside to operate the respective tail piece. A second opening is provided in such first plate to house a transmission mechanism which is operative to transmit motion from the tail piece controlled from the other plate assembly to the dead bolt control bar. Further holes are provided for receiving fasteners connecting the two plate assemblies to one another on either side of the door leaf. On the outer face of the first plate is coupled a second plate which prevents access to the motion transmission means and generally protects the first plate and the mechanism inside the door against unauthorized access. The second plate in the outer plate assembly may be made out of a hardened material and has a through going hole which is shaped in the shape of the key providing access to the cylinder lock. Preferably, the heads of the fasteners inside the first plate assembly are housed within the first plate in holes covered by the second plate. According to a preferred embodiment, the first plate is made out of a first and a second intermediate plates coupled face to face, preferably by welding.

The first plate of at least the outer plate assembly may have an opening shaped to receive a portion of the cylinder lock while holding the same against rotation. The second plate has only one opening in registration with the key hole of the cylinder.

BRIEF DESCRIPTION OF THE DRAWINGS

Other features and advantages will appear from the description by way of example of an embodiment which is given hereafter with reference to the accompanying drawings wherein.

DESCRIPTION OF EMBODIMENT

Figure 1:
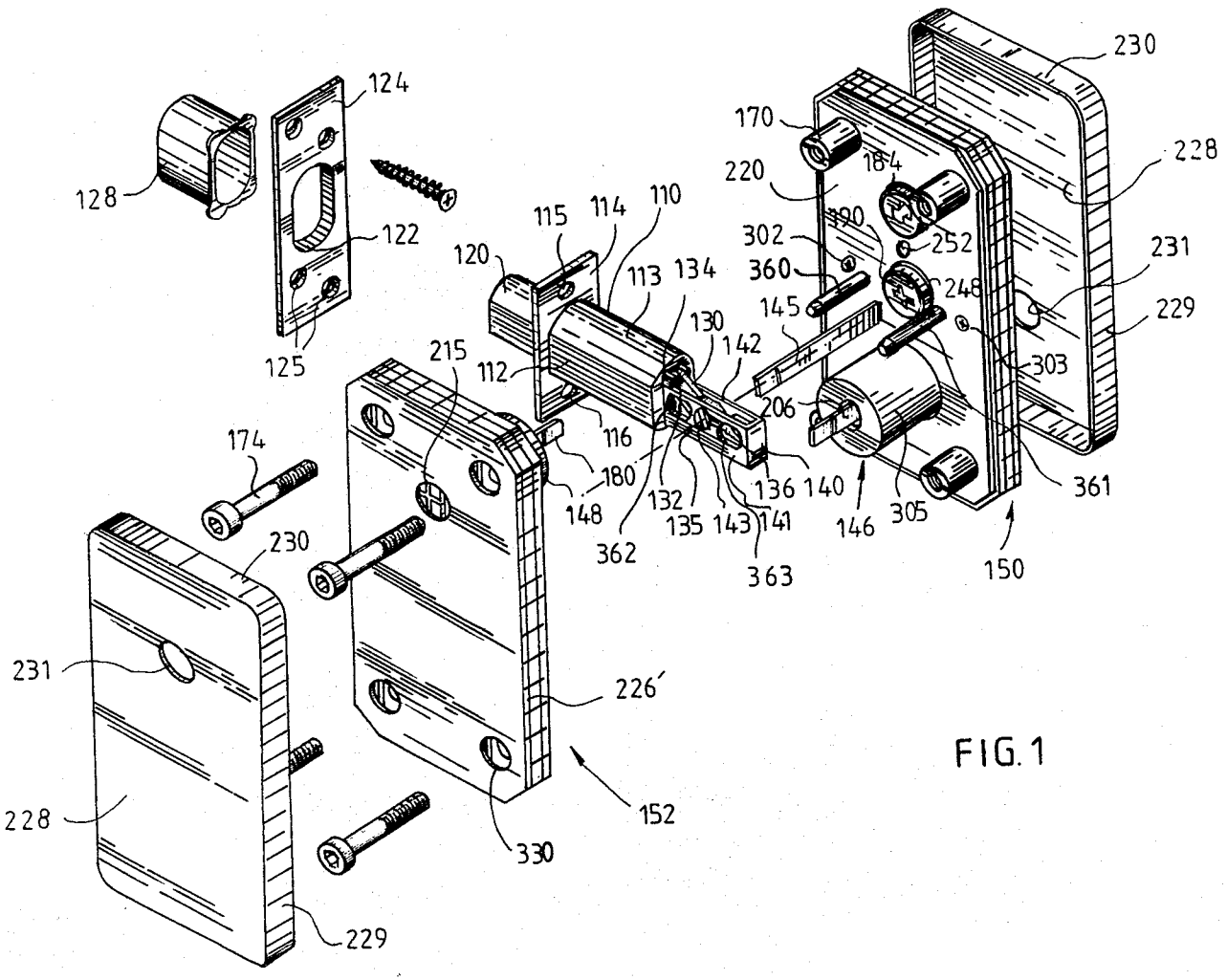
FIG. 1 is an exploded isometric view of another embodiment of the invention.

FIG. 1 shows an exploded view of another embodiment of the invention for a lock wherein the bolt and its control assembly are housed inside the door edge.

The bolt assembly proper comprises a bolt housing 110 which has an elongated shape limited by two flat side portions, such as 112, and top and bottom rounded portions 113 with an outer end coupled to a mounting plate 114 generally perpendicular to the axis of the housing 110 and having two holes 115 and 116 on either side of the bolt housing 110. The bolt housing is intended to be mounted in a horizontal receiving hole bored into the vertical edge of a door. It is secured to the door by two screws engaged through holes 115 and 116 in the edge of the door leaf.

Inside the bolt housing 110 is slidingly mounted a bolt 120 which may move between a retracted position inside the bolt housing and an advanced position as shown in FIG. 1 wherein its front end protrudes through front opening in plate 114 ahead on the door edge. In a locking position, the advanced bolt 120 is engaged through an opening 122 in a counterplate 124 which is mounted in the vertical edge of the door frame facing the door edge by means of screws engaged in holes 125, said opening 122 providing the entrance to a cavity in the door frame which is lined by an inner housing 128, as well known in the art.

The movement of the bolt 120 in bolt housing 110 is controlled by a crank arm 130 which is pivotably connected by means of pins 132 engaged in respective holes at the rear part 134 of the sliding bolt 120. The crank arm is pivotably mounted about an axis 135 by means of journals 136 rotatable in an elongated bracket 140 extending at the rear of the bolt housing 110 and secured thereto in general alignment therewith. The bracket 140 is U-shaped, the crank arm 130 being pivotably movable in a vertical plane between the two arms 141 and 142 of the bracket 140. The journal portion of crank arm 130 has a slot opening 143 formed therein which is elongated along a diameter of the journals 136. This slot 143 extends transversely all the way through the thickness of the crank arm 130 so that a flat elongated control bar 145 can be engaged through the slot opening 143 to extend on either side of the bracket 140 in a direction perpendicular to the door surface.

As the control bar 145 is rotated about axis 135, it drives the crank arm from the position depicted by FIG. 1 wherein the bolt 120 is extended, in a locking position, to a second position wherein pins 132 of the arm 130 are moved by pivoting movement of the crank arm 130 towards the end of bracket 140, thus driving the bolt in the retracted position thereof inside the bolt housing 110.

The control bar 145 may be controlled from the outside and from the inside of the door by means of two respective cylinder mechanisms generally designated by the references 146 and 148 which are associated with two respective plate assemblies, an outer plate assembly 150 and an inner plate assembly 152 which are built in accordance with the invention as will be now explained in greater detail.

Figure 2:
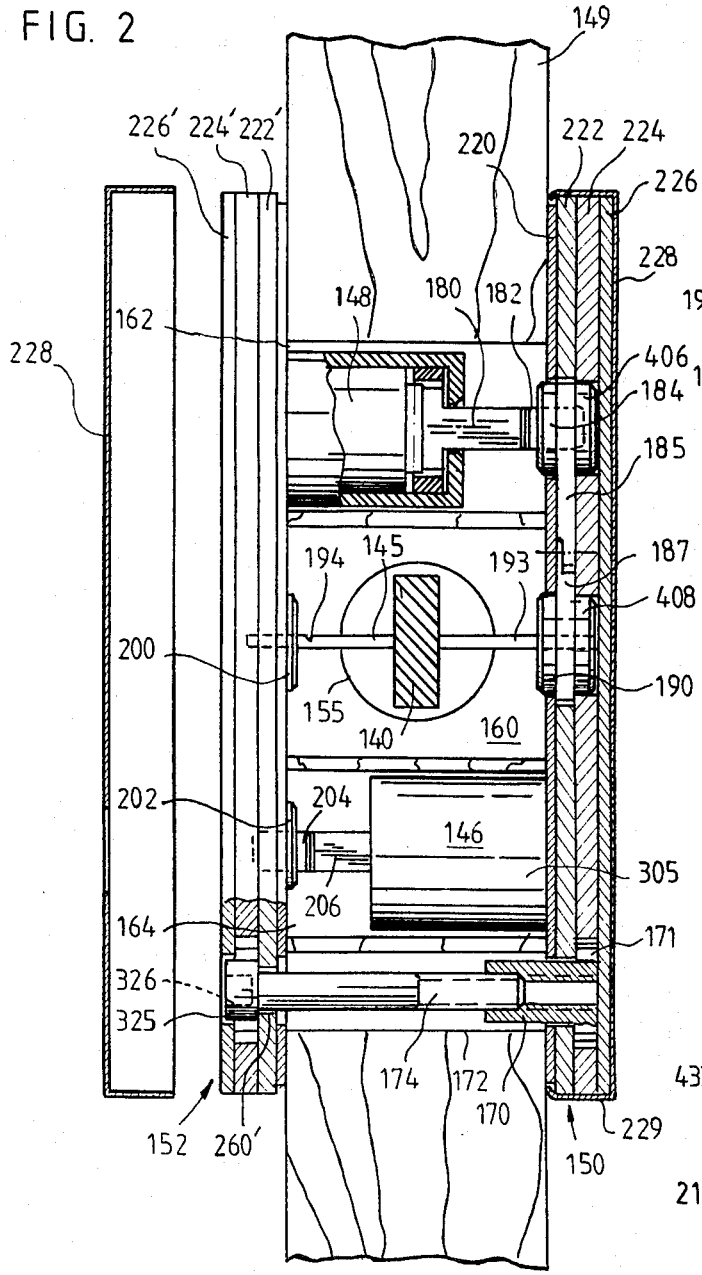
FIG. 2 is a view of a longitudinal cross-section of the plate assembly of FIG. 1 mounted on a door.
Figure 3:
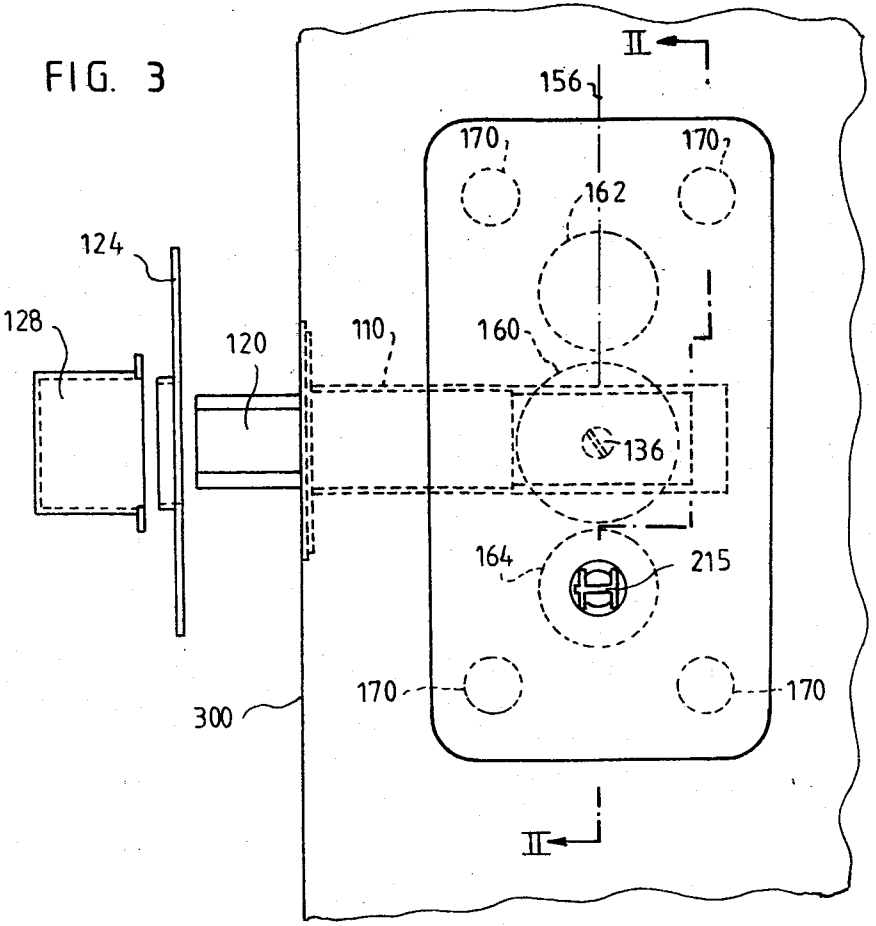
FIG. 3 is a view from the right of the assembly of FIG. 12.

FIG. 2 shows a vertical section of a door leaf wherein a lock or bolt assembly such as described is mounted in an opening 155 bored through the door, perpendicular to its vertical edge. As shown by FIGS. 2 and 3, three parallel cylindrical openings are bored through the thickness of the door whose centers are aligned along a vertical axis 156 parallel to the door edge 300: a central bore 160, an upper bore 162 within which the inner portion of a cylinder assembly 148 associated with plate assembly 152 is housed, and a lower bore 164 within which are housed the inner parts of cylinder assembly 146 associated with the external plate assembly 150.

As in the previous embodiment, the plate assemblies 150, 152 are generally rectangular in shape with their length oriented to be positionned parallel to the edge of the door leaf.

A description of the general organization of the plate assemblies and lock is given with reference to FIGS. 1 and 2. From the inner side, i.e. the side turned towards the door leaf of the plate assembly 150 depends, at each corner thereof, an elongated tubular nut 170 which extends through a portion of a fixation hole 172 drilled through the door leaf 149 and which is engaged threadingly with the respective end portion of a bolt 174 which is mounted in plate assembly 152 at a respective corner thereof and extends through the hole 172. As shown by FIG. 3, four holes such as 170 are provided for respective connection of the four corners of the rectangular plate assemblies 150 and 152 to one another in a condition wherein the plate assemblies squeeze the door leaf. Each one of these plate assemblies covers the respective openings of the fixation holes 170 and cylinder holes 162 and 164 and central hole 160.

The upper cylinder assembly 148 controls the rotating movement of a tail piece 180 whose outer end 182 is engaged in a rotatable driving wheel member 184 housed in the plate assembly 150. The rotation of this wheel 184 is transmitted via a flat gear sector 185 at its periphery which meshes with a flat sector gear 187 (FIG. 4 ) to a rotatable wheel member 190 having a diametrical slot 192 wherein one end 193 of the bolt control bar 145 is received for control thereby.

Figure 4:
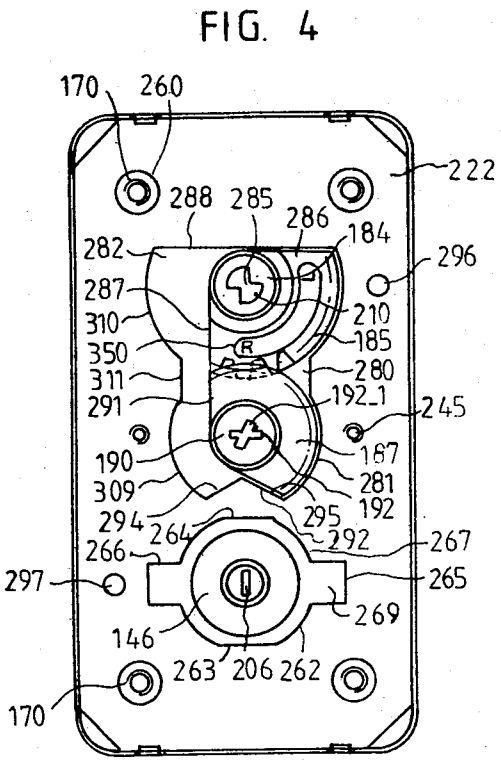
FIG. 4 is a plan view of one of the plate assemblies after taking out the inner plate cover.

In the position shown in FIGS. 2 and 4, the slot 192 extends along the transverse axis of the plate assembly 150. A second diametrical slot 192-1 is provided at an angle with slot 192 for mounting the end of flat control bar 145 when the displacement of the dead bolt 120 from its retracted to its protruding locking position is to be achieved in the direction opposite to that illustrated on FIGS. 1 and 3.

The opposite end 194 of control bar 145 is engaged in a slot in an identical center wheel 200 (FIG. 2 ) mounted for rotation within plate assembly 152. Flat control bar 145 may thus also be controlled by rotation of wheel 200 under actuation of a transmission mechanism similar to the flat gear sectors 185 and 187 but housed within the plate assembly 152. This mechanism transmits rotation of wheel 200 to a wheel 202 when the latter is driven by the end portion 204 of a tail piece 206 protruding out of cylinder lock assembly 146 which may be controlled with a key from the outer side of the external plate assembly 150.

In summary, the movement of the dead bolt 114 may be controlled, independently, from the outer plate assembly 150 by means of the cylinder assembly 146, which may be manipulated by an appropriate key from the outside of the door leaf, and from the inner plate assembly 152 by the cylinder assembly 148 again by manipulation of an appropriate key from the inside of the door leaf. In either case, the displacement of a tail piece driven by the cylinder assembly is transmitted via a motion transmitting gear assembly housed in the opposite plate to the control bar 145 for controlling movement of the dead bolt.

In order to permit independent operation of the bolt by each cylinder 146 and 148 without interfering with the other cylinder via the flat control bar 145, lost motion connection means are provided. These essentially takes the form of double fan shaped slots in wheels 184 and 202 as depicted by FIG. 4. The tip 182 of tail piece 180 is engaged in slot 210 of wheel 184 in such manner that if the cylinder 148 has caused the wheel 184 (FIGS. 1 and 4) to rotate a quarter of a turn in one direction from the position shown in FIG. 4 to actuate the bolt 114, the tail piece may return to its initial position by rotating a quarter of a turn in the other direction without causing movement of the wheel 184. Subsequent actuation of the other cylinder 146 to return the bolt back to its original position will in effect cause rotation of the wheel 184 in the opposite direction, i.e. counter clockwise, via the control bar 145 and wheel 187 without affecting the position of the tail piece 180. More specifically, in their normal rest position, the tail pieces 180 and 206 have their flat portions parallel to the longitudinal axis of the plate, as seen in FIG. 2. Thus, if by actuation of the cylinder block 148 the tail piece 180 has driven pinion 185 to its right most abutment position depicted in FIG. 4, thereby driving the dead bolt 120 in one of its extreme positions, the tail piece 180 may be brought back to the vertical position in a clockwise direction, by turning within the fan shaped slot 210 without driving back pinion 185, until the key may be withdrawn from the cylinder lock 148. When the tail piece 180 has returned to this position, it is possible by operating tail piece 206 from the other side of the door to drive the dead bolt back to its original position via the transmission means housed in plate 152. This movement of the control bar causes counter clockwise rotation of the pinion gear 187 which in turn drives pinion 185 clockwise towards its leftmost abutment position without being hindered by tail piece 180 in double fan shaped slot 210. Of course, a similar lost motion connection is also provided between the tip of the tail piece 206 at the output of cylinder assembly 146 and the wheel 202 on the inner face of plate assembly 152.

While the embodiment of FIGS. 1 to 4 has been shown with two cylinder locks, each of which may be actuated separately by a respective key, the inner cylinder lock (which may be operated from the inside through a key opening which is visible at 215 on FIGS. 1 and 3) may be replaced by a conventional knob driving mechanism, i.e. wherein a tail piece such as 180 is rotated by actuation of a knob accessible on the outer face of the inner plate assembly 152.

The double plate lock assembly thus described provides a safety lock whose operating parts are nearly entirely housed within the door itself. By arranging the cylinder locks in parallel within the door, no protuberance is required outside the door except for the thickness of the plates themselves.

Thus, advantage is taken of the high safety provided by plate assemblies such as described, particularly at the outside of the door where special high resistance treatment may be applied to the protection plate. Nevertheless, the overall lock once assembled on the door remains quite thin and unobstrusive.

In the embodiment described, each plate assembly 150 and 152 may be constructed in a manner substantially similar to the external plate assembly described with reference to FIG. 2 of the parent application mentioned above, with the special provision that each one of these plate assemblies houses a gear transmission mechanism which is actuated by a tail piece, operated from the opposite plate assembly in order to position a dead bolt control bar 145. Some other differences will appear from the more detailed description which follows. In addition, particularly if the cylinder lock to be operated from the inside is replaced by a simple knob mechanism, some of the protective features of the inner plate assembly 152 may be omitted. Of course, an advantage of providing an inner key operated cylinder, and a protective plate assembly 152 is that unauthorized opening of the locked door is not be possible from the inside, thus for example preventing an easy exit of persons having illegally entered the premises through another passageway, for example a window.

Turning now to the outer plate assembly 150 (FIG. 2), the latter comprises, when proceeding from the inner side towards the outer side of the assembly, an inner cover plate 220, then a first plate 222 whose inner face is clearly visible on FIG. 4 after cover plate 220 has been taken off. A second plate 224 is soldered to the outer face of plate 222. A third plate 226 which is made of a specially treated hardened steel material, is coupled by soldering to the outer face of the second plate 224. Finally, the entire plate assembly 150 is encased in a cup-shaped cover plate 228 having side walls 229 covering the edges of the first, second and third plates. Tabs 230 are provided (see FIG. 1) at spaced apart locations along the edges of said side walls 229 which may be folded around the rim of the first plate 222 to hold the cup cover 228 in place. The outer dimensions of plate cover 220 are slightly smaller than those of plates 222, 224 and 226, so as to allow the tabs 230 of the cup shaped cover plates 228 to be bent around the inner face of first plate 222. This cup has an outer decorative finish and an opening 231 formed therein for providing a key access to the respective cylinder lock. The cover plates 228 are similar for the inner and outer plate assemblies 151 and 152.

Figure 5:
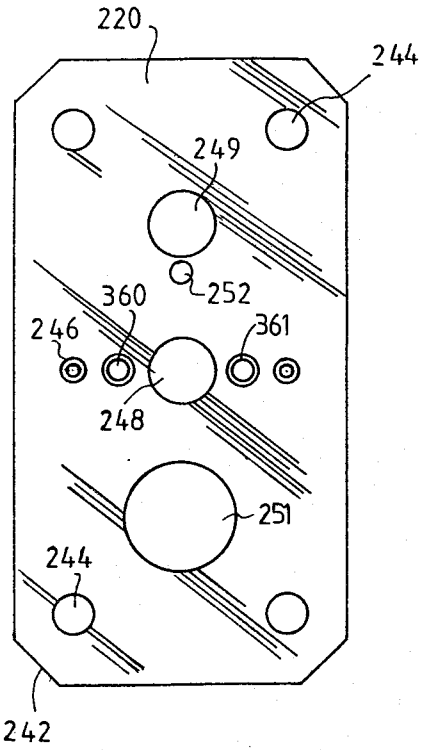

Each plate constituting the assembly 150 will now be described. As shown by FIG. 5, the inner cover plate 220 has its corners cut as visible at 242. Four passage holes 244 are provided for the shafts of the elongated nuts 170. Two spaced aparts tapered holes 246 are provided on the transverse axis of the plate 220 for mounting on its inner face the heads of screws 302, 303 (FIG. 1) securing this plate 220 to the inner face of the first plate 222. The shafts of these screws are threaded into corresponding tapped holes 245 in plate 222 (FIG. 4). The plate 220 has a center hole 248 for accommodating the inner face of control bar driving wheel 190 and above it is bored a circular hole of same diameter 249 for accommodating the corresponding inner face of wheel 184. The plate also has a circular hole 251 through which passes the body portion 305 (FIG. 1) of the cylinder assembly 146 which is housed within the bore 164 in the door leaf. A window hole 252 is provided between holes 249 and 248 for displaying an indication of the position of sector gear 185, such as R for one position thereof and L for the other position, as clearly visible on FIGS. 1 and 4.

FIG. 4 is a view of the inner part of plate assembly 150 after plate 220 has been taken off, which shows the features of the first plate 222.

Plate 222 has four corner passage holes 260 for passage of the elongated nuts 170 therethrough. Below the center of symmetry of the plate 222 is cut an opening 262 whose shape comprises two opposite flat sections 263 and 264 longitudinally aligned and two transversely spaced apart ear shaped recesses 265 and 266. The flat portions 263, 264 and the ear shaped recesses 265 and 266 are connected by four arcuate portions such as 267. The shape of the contour of this opening 262 corresponds to that of a portion of the outer contour of the cylinder assembly 146 which is housed in plate 222, so as to lock this cylinder assembly 146 against rotation within the plate assembly, as explained in the above identified parent application.

Inside plate 222 is also formed a transmission housing window 280 comprising a first portion 281 adapted to house the flat gear section 187 which is mounted pivotable about an axis perpendicular to the plate at the center of symmetry of the plate assembly 150 (see axis 135 of FIG. 1 ). The opening 280 comprises a second portion 282 for housing flat gear section 185 which is rotatable about an axis 285 which is in registration with the axis of rotation of the tail piece 180 controlled from the second plate assembly 152 (see FIG. 2). Both gear sections 187 and 185 are sector gear meshing with one another to jointly rotate between two respective abutment positions corresponding to the fully open and fully locked positions of the dead bolt 114. These gears remain constantly in mesh. Their angular extent corresponds to a rotation of 90° for gear 185 and a rotation of 120° for gear 187 between the two extreme positions of crank arm 130. Wheels 184 and 190 are molded integrally respectively with gear 185 and 187, coaxially therewith. Sector gear 185 is limited by two rectilinear side faces 286 and 287 extending tangentially of wheel 184 and forming an angle of 90° therebetween. In the position shown in the drawing side face 286 abuts against a flat transverse edge 288 of the window portion 282 whereas in the opposite abutment position it is side face 287 which abuts against the other portion of the same flat edge 288 of the window.

Similarly, gear 187 is limited by two rectilinear sides 291 and 292 extending tangentially of wheel 190 and forming an angle of 120° therebetween. Sides 291 and 292 cooperate with two respective abutment edges 294 and 295 in the first portion 281 of window 280, these two abutment portions forming an inwardly directed angle of about 120° at the end of opening 280 opposite flat edge 288. Between these edges, the two opening portions 281 and 282 have respective arcuate edge portions 309 and 310 sized to accommodate the sector gears 185 and 187 housed therein and connected by a straight longitudinal section 311.

Figure 7:
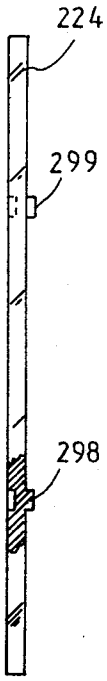
FIG. 7 is a side view of the plate of FIG. 6.

Two centering holes 296 and 297 are also provided in plate 222 to receive, on the outer face thereof, two respective lugs 298 and 292 in plate 224 (see FIG. 7). These holes and lugs help keep plates 222 and 224 properly aligned when they are spot welded at the manufacturing stage.

Plate 224 has four corner holes 400 having a substantially rectangular shape with a width about equal to the diameter of the elongated nut shaft 170. These nuts 170 have a rectangular head 171 (see FIG. 2) whose length is greater than the diameter of passage holes 260 in plate 222 and may be housed in openings 400 whereby rotation of the nuts 170 is prevented. The thickness of the head 171 is substantially equal or slightly smaller than the thickness of plate 224. In addition, plate 224 comprises two circular openings 402 and 404 which are positioned so that their circular side walls act as bearings for cylindrical bearing portions respectively 406 and 408 which extend from the pinion gears 185 and 187 on the outer face thereof. Finally, plate 224 has a further opening 410 of substantially circular shape with two transversely spaced apart ear sections 412 for housing and locking against rotation a portion of the cylinder assembly 146 having corresponding shape and thickness as explained in the above mentioned parent application.

Figure 9:
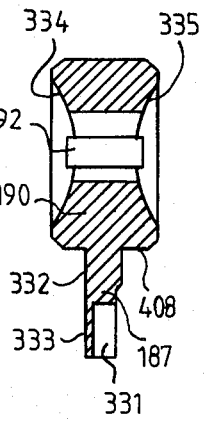
FIG. 9 and 10 are views of cross-sectional sections of gear members used in the assembly.

As clearly seen on FIG. 9, wheel portion 190 and bearing portion 408 extend somewhat symmetrically on either side of the pinion sector 187. Teeth 331 at the periphery of the sector gear 187 do not extend all the way from one side to the other of gear 187. They are limited on the inner side 332 of this gear by a continuous web 333. Both the inner face 334 and the outer face 335 respectively of wheel 190 and bearing 408 are concavely shaped.

Figure 10:
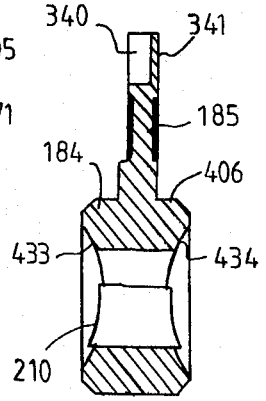

As shown in FIG. 10, wheel portion 184 and bearing portion 406 extend somewhat symmetrically apart from the gear section 185. The teeth 340 at the periphery thereof do not extend all the way from the inner side to the outer side of the gear plate, a web 341 connecting this teeth on this outer side. This arrangement makes the molding of pinion gears 185 and 187 easier. The overlap of web 333 over the side of teeth 340 of gear section 185 is clearly visible on FIG. 2.

As in the case of FIG. 9, the inner face 433 of head 184 and outer face 434 of bearing portion 406 are concavely shaped. The double fan opening 210 extends all the way through between faces 433 and 434.

Figure 8:
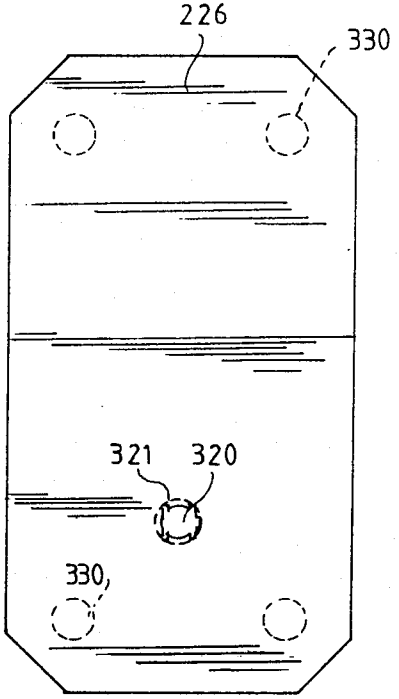
FIGS. 5, 6 and 8 are plan views of the different plates forming the plate assembly of FIG. 4.
Figure 6:
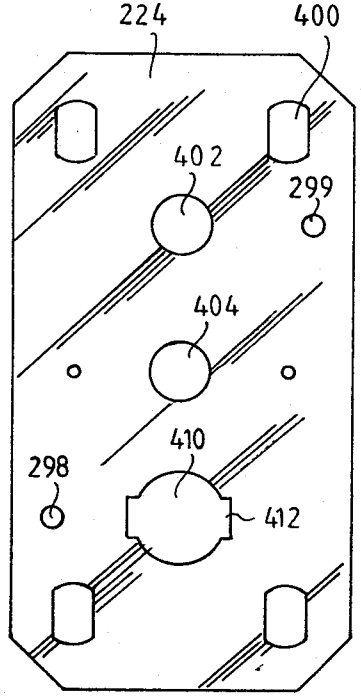

Except for a portion of hole 410, all openings of plate 224 (FIG. 6) are covered by a solid plate 226 as depicted by FIG. 8 which is electrically spot welded to the outer face of plate 224 and resists drilling so as to offer protection against any attempt of fraudulent access to the nuts 170, the gear assembly 185 and 187, and the cylinder assembly 146. The plate 226 has only one opening 320 shaped in accordance with general shape of a key for access to the entry of the cylinder assembly and in registration therewith.

Cylinder lock 186, wheel 190 and 184 are normally held in place, when the plate assembly 115 is not mounted, by the inner plate 220 fixed by the two screws 302 and 303. In this position, wheels 190 and 184 protrude through inner plate 220 within the corresponding bores in the door 149. The sector gears 185 and 187 which are held in place within opening 280 between plates 220 and 224 have a thickness somewhat smaller than that of the first plate 222 to provide suitable clearance for rotation without substantial friction.

On assembly of plate 150, the rectangular nut heads 171 are inserted in their respective housings prior to welding plate 226 on plate 224. The nuts 170 have sufficient play to help correct any slight misalignment with the respective bolts 174 upon mounting.

Gear section 185 is first inserted in the opening 280 with its bearing portion 406 within hole 402 and brought to the abutment position of FIG. 4, if this outer plate assembly is to drive the dead bolt in one direction towards its locking position. The gear section 187 is then inserted with its edge 291 aligned with edge 287. When the plate 220 is screwed in place, the letter R on the label 350 of plate 185 will appear through window hole 252. Control bar slot 192 is horizontal.

If the plate assembly 150 is intended to control the locking movement of the dead bolt in the opposite direction, gear 185 will first be mounted with its edge 287 against abutment edge 288 and gear 187 then having its edge 295 longitudinally aligned with edge 286. The symbol L will show through window 252 after mounting plate 220 and slot 192-1 will be in a transverse position ready for receiving the control end 193 of control bar 145.

The cylinder lock 146 has a flat terminal outer face with the respective key hole which is maintained substantially flush with the outer face of plate 224 when the respective ear portions are engaged within ear recesses 412. In this position, the cylinder key hole is in exact registration with the key shaped hole 230 for protection plate 226. As in the embodiment described in the parent application, the cylinder body has another section with blocking ears which come for insertion within the respective opening of plate 222. The inner face of this ear portion is held in place by inner plate 220.

The plate assembly 152 is constructed basically in the same way as just described in connection with plate assembly 150. Plates 220, 222 and 224 are constituted very much in the same way as those of assembly 150 with a few exceptions as indicated below. The first plate 222' of assembly 152 has corner holes 260' (see FIG. 2) which are of slightly smaller diameter than corner holes 260 of plate 222 (FIG. 4). Through these holes 260' are inserted the shafts of bolts 174, the outer rim of holes 260' being engaged by the enlarged head 325 of the bolt 174. These heads are cylindrical externally, each having an hexagonal bore 326 formed in the outer face thereof, so as to be operated by an Allen-type wrench to screw the bolts 174 into the elongated nuts 170 upon mounting the plate assemblies and cylinder locks to the door leaf. The heads 325 of bolts 174 are slightly thicker axially than the thickness of the second plate 224' which is identical with the like referenced plate of the first plate assembly, the diameter of these heads being very nearly equal to the width of the rectangular corner holes 400 of plate 224'.

Contrary to the plate assembly 150, the third cover plate 226' of assembly 152 comprises, in addition to the key hole such as 320, four circular corner holes shown in dotted line 330 on FIG. 8, with a diameter just sufficient for allowing the heads 325 of bolts 174 to be admitted inside the plate assembly 152 (FIG. 1 ), the upper surface of the heads 325 being flushed or slightly recessed with respect to the outer face of plate 226'. In plate 226' key shaped hole 320 may be replaced by a circular hole 321 for access to the key hole of the respective cylinder lock or for a knob actuation mechanism of the tail 180 inside the premises.

After the two plate assemblies are mounted to the door leaf by tightening the bolts 174 in the respective nuts 170, the hexagonal bores 326 may be plugged with a hard steel pin ball before the cover plate 228 is put in place, thus avoiding or making difficult any unauthorized unmounting of the double plate combination assembly. Also, while the plate 226 is subjected to a nitridation process for hardening the same, this treatment may be omitted for plate 226'.

In a typical embodiment, the plates are formed by stamping.

The overall thickness of a plate assembly such 150 this is about ½ inch.

In the embodiment illustrated by FIGS. 1 and 5, two parallels pins 360 and 361 are secured to the door side face of plate 220 of the outer plate assembly 150, each between opening 248 and a respective one of openings 246. As shown by FIG. 1, in the assembled condition of the lock each pins 360 and 361 is engaged in respective opening 362 and 363 in the arms 141 and 142 of U shaped bracket 140. These pins help centering the plate on mounting the lock assembly and reinforcing the same. In particular, if the wood constituting the door leaf is of poor quality, these pins are effective to keep the dead bolt 120 from moving forward when the door is slammed shut.

I claim:

1. A combination of plate assemblies for use in a high safety lock having a control bar for actuating a dead bolt in an edge of a door leaf and means, including a first and a second tail piece, accessible on either side of the door leaf for controlling motion of the control bar, said combination comprising a first plate assembly adapted to be mounted on the outer face of the door leaf and a second plate assembly which is adapted for being mounted on the inner face of the door leaf;

each said plate assembly comprising:

a first plate adapted to be placed on the side of the door leaf and having formed therein a first passage opening for providing a controlling access from the outside of said plate assembly to a respective one of the tail pieces; and at least a second opening for housing a portion of said controlling means which is operative to transmit motion from the other of said tail pieces to the control bar; and a second plate coupled to the first plate on the outer face thereof for preventing access from the outside of said plate assembly to the second opening in said first plate and comprising a through going hole to provide controlling access from the outside of said plate to said one tail piece via said first opening in said first plate.

2. The combination of claim 1, wherein said first plate of each of said plate assemblies comprises means in said first opening thereof for blocking a portion of said controlling means against rotation.

3. The combination of claim 1, wherein, at least for said first plate assembly, said through going hole in said second plate is a key hole shaped in accordance with the contour of a key to actuate said controlling means for operating the first tail piece.

4. The combination of claim 1, further comprising an inner plate adapted to be coupled to the inner face of said first plate, said inner plate being operative to hold said motion transmitting portion of said controlling means in place in said second opening of said first plate.

5. The combination of claim 1, wherein each of said plate assembly comprises an external plate having one opening access to said through going hole of said second plate thereof and lateral walls extending over the edges of said first and second plates for encasing the same.

6. The combination of claim 1, further wherein said first plates of said first and second plate assemblies each have holes adapted to be mounted in registration with one another when said first and second plate assemblies are mounted on a door leaf for passing fastening means for securing said first and said second plate assemblies to one another, on either side of said door leaf.

7. The combination of claim 6, further comprising means for housing respective ends of the fastening means on the inner side of said second plate of said first assembly.

8. A combination of plate assemblies for use in a high safety lock having a control bar for actuating a dead bolt in an edge of a door leaf and means, including a first and a second tail piece, accessible on either side of said door leaf for controlling motion of the control bar; said combination comprising a first plate assembly adapted to be mounted on the outer face of the door leaf and a second plate assembly which is adapted for being mounted on the inner face of the door leaf, at least said first plate assembly comprising:

a first plate adapted to be placed towards the door leaf and having formed therein a first opening for providing controlling access from the outside of said plate assembly to a respective one of the tail pieces and at least one second opening;

first and second motion transmitting members rotatably mounted in said second opening of said first plate, said first member including means for rotatably connecting the same with the other one of the tail pieces and said second member including means for rotatably connecting the same with the control bar;

transmission means between said first and second members in said second opening of said first plate for transmitting rotation of the tail piece to said control bar; and a second plate coupled to said first plate on the outer face thereof for preventing access from the outside of said plate assembly to the second opening of said first plate and comprising a through going hole to provide a controlling access via said first opening in said first plate to the one tail piece.

9. The combination of claim 8, wherein said transmission means include first and second flat gear sections respectively coupled to said first and second members and in meshing engagement within said second opening in said first plate.

10. The combination of claim 8, wherein said connecting means between said other tail piece and the first member includes a lost motion connection adapted to permit rotation of said first member in one direction without interfering with said other tail piece.

11. A safety lock comprising:

a first and second tail pieces;

first and second respective tail piece actuating mechanisms, at least said first actuating mechanism being a key controlled safety lock;

a first plate assembly adapted to be mounted on the outer face of a door leaf and a second plate assembly which is adapted to be mounted on the inner face of the door leaf, each of said plate assemblies comprising:

a first plate adapted to be placed on the side of the door leaf and having formed therein a first opening for receiving a portion of a respective one of said actuating mechanisms wherefrom the respective tail piece extends inwardly of said respective plate assembly, and a second opening;

means housed in said second opening including a first member adapted to be rotatably coupled with the tail piece under control of the other of said actuating mechanisms, a second rotatable member, and means for transmitting rotary motion between said first and second members in said second opening; and a second plate coupled to the first plate on the outer face thereof for preventing access from the outside to the second opening in said first plate and comprising a through going hole providing access to the tail piece actuating mechanism housed in the first opening of the respective first plate.

12. The safety lock of claim 11, further comprising a dead bolt, means for slidingly mounting the dead bolt therein, said means adapted for mounting in a door edge to allow the dead bolt to slide between one retracted position within the door edge and another position protruding out of this edge in a door locking position, means for actuating the dead bolt within said mounting means comprising a control bar adapted to be coupled to said second rotatable member of each one of said first and second plate assemblies and means for translating the rotary motion of said control bar into a sliding motion of said dead bolt.

13. The safety lock of claim 11 or 12, wherein said first opening of said first plate assembly has means for locking the cylinder lock of said first actuating mechanism against rotation therein.

14. The safety lock of claim 11 or 12, wherein said second plate of said first assembly is a hardened steel plate and said through going hole is shaped in accordance with the key hole of the cylinder lock of said first actuating mechanism.

15. A combination of plate assemblies for use in a high safety door lock having a control bar for actuating a dead bolt and means, including first and second tail pieces and a cylinder lock operable by a key from the outer side of the door leaf, for controlling the operation of the control bar, said combination comprising:

a first plate assembly adapted to be mounted on the outer face of the door leaf and a second plate assembly adapted for mounting on the inner face of the door leaf;

said first plate assembly comprising:

a first plate having a first passage opening, formed therein for providing controlling access via the cylinder key to the first tail piece;

at least one second opening for housing a portion of said controlling means for transmitting motion from the second tail piece to the control bar;

and a plurality of holes for receiving fastening means having an outer end which is wider than said passage holes;

a second plate coupled with the outer face of said first plate and having holes formed therein for housing wider end portions of the fastening means; and a third plate coupled to the outer face of said second plate; and a second plate assembly comprising a first plate adapted to be placed on the side of the inner face of the door leaf and having a first opening for providing controlling access to the second tail piece;

a second opening for housing a portion of the controlling means for transmitting motion from the first tail piece actuated by the cylinder means to the control bar and a plurality of passage holes adapted to be placed in registration with the holes in said first plate of said first plate assembly to receive the fastening means associated with said first plate assembly.

16. The combination of claim 15, wherein said second plate assembly further comprises a second plate coupled to said first plate thereof on the outer face thereof and having holes therein for housing wider ends of the fastening means on the inner side of the door leaf, said second plate also having a passage therethrough for providing access to the controlling means from the outside of said second plate assembly.

17. The combination of claim 16, further wherein said second plate assembly comprises a third plate coupled to the outer face of said second plate thereof and having a through going hole for providing access to the controlling means from the outside of said second plate assembly.

18. The combination of claim 15, further wherein said second plate of the first assembly also has at least one further opening formed therein opposite said first plate opening for housing the motion transmitting portion, said further opening forming a bearing for a rotatable part of the motion transmitting portion.

19. The combination of claim 15, further wherein said holes in said second plate are shaped in relation to the wider end portions of said fastening means to prevent rotation of the same.

20. The combination of claim 16, further wherein said third plate of the first plate assembly covers the holes for housing the ends of said fastening means and said second plate assembly comprises a third plate having holes in registration with said passage holes for the fastening means in the second plate of the second plate assembly, said third plate having a through going hole providing access to the controlling means.

21. A combination of plate assemblies for use in high safety lock having a control bar for actuating a dead bolt in an edge of a door leaf and means including a first and a second tail piece, accessible on either side of the door leaf for controlling motion of the control bar;

said combination comprising a first plate assembly adapted to be mounted on the outer face of the door leaf and a second plate assembly which is adapted for being mounted on the inner face of the door leaf;

at least said first plate assembly comprising: a first intermediate plate adapted to be placed on the side of the door leaf and having formed therein a first passage opening for providing controlling access from outside to operate a respective one of the tail pieces and at least one second opening for housing a first driving member which may be rotatably coupled with the other of said tail pieces and a second driving member adapted to be rotatably coupled to the control bar, said first and second members being drivingly connected to one another;

a second intermediate plate coupled to the outer side of said first intermediate plate and having formed therein: a first passage opening in registration with said first passage opening of said first intermediate plate for providing controlling access from outside to operate said respective tail piece; at least a second opening for housing a bearing portion of the first driving member; and at least a third opening for housing a bearing portion of the second driving member; and a third plate coupled to the outer face of said second intermediate plate and covering said second and third opening therein, said third plate having a through going hole formed therein in registration with said first passage openings of said first and second plates.

22. The combination of claim 21, further wherein said first intermediate plate has a plurality of additional holes formed therein for receiving means for securing said first plate assembly to said second plate assembly; and said second intermediate plate has additional openings in registration with said additional holes in said first intermediate plate but wider so as to each receives therein an enlarged portion of the securing means in engagement with the outer face of said first intermediate plate at the edge of respective additional hole.

23. The combination of claim 22, wherein the additional openings in the second intermediate plate of said first plate assembly have a non-circular cross-section so as to prevent rotation of the securing means enlarged portion therein.

24. The combination of claim 22, further wherein said wider openings in said second intermediate plate of the first assembly are covered by said third plate thereof.

25. The combination of claim 21, further comprising an inner plate and means for fastening this inner plate to the inner face of said first intermediate plate of said first assembly, said inner plate adapted to hold said first and second driving members in said second opening of said first intermediate plate.

26. The combination of claim 21, further wherein at least one of said first openings in said first and second intermediate plates of at least one of said plate assemblies is shaped for receiving a cylinder lock while preventing rotation thereof.

27. The combination of claim 21, further comprising an outer cover plate having side walls for encasing said first, second and third plates of each assembly.

28. A combination of plate assemblies for use in a high safety lock having a control bar for actuating a dead bolt and having means including a first and a second tail piece for controlling said control bar from either side of said door leaf, said combination comprising a first plate assembly which is adapted to be mounted on the outer face of the door leaf and a second plate assembly which is adapted for being mounted on the inner face of such door leaf, each said plate assemblies comprising:

a first plate adapted to be placed on the side of a respective face of the door leaf and having formed therein:

a first passage opening for providing controlling access from the outside of said plate to operating one of said tail pieces;

at least one second opening for housing a portion of the controlling means for transmitting to the control bar motion of the other one of the tail pieces; and a plurality of passage holes having each an inner and an outer portion, said outer portion being wider than said inner portion;

and wherein at least said first assembly further comprises a second plate coupled to the first plate on the outer face thereof and comprising a through going hole adapted to provide access from the outside of said plate to the controlling means to operate the respective tail piece in said first plate.

29. The combination of claim 28, further wherein said second plate of said first assembly covers said outer hole portions.

30. The combination of claim 29, further comprising fastening means having a shaft and a head larger than the shaft, said head being housed in said outer passage hole portion of the first plate.

31. The combination of claim 30, wherein said outer portion of said passage holes in said first plate of the first plate assembly is operative to prevent rotation of the head of said fastening means housed therein.

32. The combination of claim 28, further wherein said second assembly also has a second plate coupled with the first plate on the outer face thereof and having a through going hole adapted to provide access from the outside to the controlling means.

33. The combination of claim 32, wherein said second plate of said second assembly further includes holes in registration with said outer portion of said passage holes in said first plate of said second assembly.

34. The assembly plate combination of claim 31, wherein said fastening means of said first plate assembly are nuts.

35. The combination of claim 28, wherein the first passage opening formed in said first plate of the first plate assembly is shaped for immobilizing a cylinder safety lock in the controlling means against rotation.

36. The combination of claim 28, wherein said first opening in the first plate of said first plate assembly is adapted to receive a cylinder lock in the controlling means having a key hole in said first opening, said through going hole in the second plate of said first plate assembly having the shape of the key hole of said cylinder.

37. The combination of claim 28, wherein said second plate of said first plate assembly is made out of a hardened metal material.

* * * * *